US005803656A

United States Patent [19]

Turck

[11] Patent Number: 5,803,656

[45] Date of Patent: Sep. 8, 1998

[54] POWERED, ROLER-TYPE CONCRETE SCREED

[76] Inventor: Jeffrey Turck, 23671 Alexandria St., Carthage, N.Y. 13619

[21] Appl. No.: 741,559

[22] Filed: Oct. 31, 1996

[51] Int. Cl.[6] ..... E01C 19/22

[52] U.S. Cl. ..... 404/103; 404/118; 404/85; 404/97; 404/122

[58] Field of Search ..... 404/96, 97, 101, 404/103, 118, 122, 131, 85

[56] References Cited

U.S. PATENT DOCUMENTS

| | | | |
|---|---|---|---|
| 2,334,086 | 11/1943 | Greiner | 404/122 X |
| 3,067,656 | 12/1962 | Gustafsson | 94/45 |
| 3,547,014 | 12/1970 | Austin | 404/131 X |
| 3,698,293 | 10/1972 | Wagner | 94/50 |
| 3,801,211 | 4/1974 | Perkins | 404/75 |
| 4,073,593 | 2/1978 | Storm | 404/114 |
| 4,142,815 | 3/1979 | Mitchell | 404/103 |
| 4,614,486 | 9/1986 | Bragagnini | 425/62 |
| 4,641,995 | 2/1987 | Owens | 404/118 |
| 4,650,366 | 3/1987 | Morrison | 404/114 |
| 4,702,640 | 10/1987 | Allen | 404/75 |
| 5,062,738 | 11/1991 | Owens | 404/114 |
| 5,190,401 | 3/1993 | Wilson | 404/118 |
| 5,228,799 | 7/1993 | Sondreal | 404/131 X |
| 5,456,549 | 10/1995 | Paladeni | 404/103 |
| 5,480,259 | 1/1996 | Thrower | 404/131 X |

FOREIGN PATENT DOCUMENTS 470623 1/1951 Canada .

*Primary Examiner*—James Lisehora

[57] ABSTRACT

A powered concrete screed apparatus comprising a roller rotatably attached to a chassis. The chassis includes an elongated member that extends in spaced, parallel relation to the roller, and is of substantially the same length as the roller. The elongated member is attached to the roller at one end by a motor removably mounted thereto and which includes gears extending therefrom which are operatively attached to the roller, and at its opposite end by a plate which extends between the tubing and roller. A pair of handles are mounted to and extend upwardly from the tubular member, and are independently, slidably adjustable along the length of the tubular member. The handles are also telescopically adjustable, thereby permitting their lengths to be selectively controlled. A throttle is removably attached to one of the handles and electrically connected to the motor, thereby permitting selective control of the power output from the motor. The screed apparatus also include a pair of wheel assemblies attached to the tubular member at opposite ends thereof. The wheel assemblies permit the apparatus to be easily moved to and from a worksite without damaging the roller.

55 Claims, 5 Drawing Sheets

10
79
80
61
61
81
60
60
70
70
72
82
62
72
62
89
92
88
94
86
72
74
72
64
76
82
92
80
66
90
89
88
94
86
76
80
76
64
66
68
78
68
84
90
78
84
32
34
36
40
40
38
46
14
36
54
116
30
26
18
52
50
28
56
58
81
22
44
18
16
12
42
44
24
48

POWERED, ROLER-TYPE CONCRETE SCREED

BACKGROUND OF THE INVENTION

The present invention generally relates to roller-type concrete screeds, and more particularly to a powered screed apparatus having a walk behind chassis attached thereto.

Immediately after concrete is poured to form a sidewalk, road surface, or similar pavement structure, it must be finished, or screeded, to make it level and relatively smooth. The concrete finishing has typically, and most simplistically, been done by running a predetermined length of lumber (such as a 2×4) or other type of strike board across the top surface of the concrete. The strike board is usually hand-held or attached to a user by a harness which permits the board to be drawn back and forth across the freshly poured concrete at a constant rate, thereby leveling and smoothing its surface. While such a manual system works effectively for small areas, it is a time consuming, inefficient manner for screeding large areas.

Screeds having motors attached thereto to expedite the finishing process are well known in the art. Some of the powered screeds include flat screed boards having a vibratory mechanism attached thereto which will cause the board to vibrate across the concrete, thereby leveling, compacting and smoothing its surface. Examples of such screeds can be readily observed in U.S. Pat. Nos. 4,650,366 to Morrison; 4,641,995 to Owens; 4,073,593 to Storm; and 3,067,656 to Gustafsson, as well as Canadian Patent No. 470,623 to Barnes.

Another type of power screed known in the prior art may be generically categorized as powered, roller-type screeds. U.S. Pat. Nos. 3,698,293 to Wanger; 5,062,738 to Ownes; and 4,614,486 to Bragagnini all disclose powered, roller-type screed apparatus. Each of the apparatus described in those patents include at least two screeding members; either two or more rollers, or a roller and a screed plate. The use of multiple screed members permits the concrete to be more firmly compacted, while reducing the number of back and forth passes needed to be made with the apparatus. The rollers are passed over the concrete while rotating about their longitudinal axis in a direction opposite the direction of travel. This movement produces a smooth, flat finish to the concrete. Although the prior art, powered, roller-type screeds are effective, they all employ multiple screed members which adds to the cost, complexity of manufacture and use, and versatility of the devices.

It is therefore a principal object of the present invention to provide a powered, roller-type screed apparatus which is versatile and effective for use on any type of concrete pavement surface.

It is another object of the present invention to provide a roller-type screed which is inexpensive and easy to use.

Other objects and advantages of the present invention will in part be obvious and in part appear hereinafter.

SUMMARY OF THE INVENTION

In accordance with the foregoing objects and advantages, the present invention provides a powered, roller-type screed apparatus having an adjustable, walk behind chassis attached to the roller. A gasoline powered motor is removably attached to either end of the chassis, and includes a worm gear extending downwardly therefrom which meshingly engages a gear operably attached to the roller. The relationship between the gears effects rotation of the roller about its longitudinal axis upon actuation of the motor. The amount of power transferred from the motor to the roller, and hence the rotational speed of the roller is selectively controlled by the user via a throttle electrically connected to the motor.

The roller is hollow with open ends and may be manufactured from aluminum, stainless steel, or any other suitable metal. Mounted just inside each of the roller's two ends is a bracket which extends diametrically across the inside of the roller and is fixed thereto adjacent its ends. The bracket includes an opening formed centrally therethrough which is shaped to cooperatively receive a drive shaft therein. The shape of the opening, as well as the cross-section of the stub shaft, is predominantly circular with one straight edge. This shape permits the shaft to effectively engage and not slip with respect to the bracket.

The chassis of the screed apparatus is comprised of an elongated strip of square cross-section tubing that extends in spaced, parallel relation to the roller, and is of substantially the same length as the roller. The chassis is attached to the roller at one end by the motor and gear combination, and at its opposite end by a plate which extends between the tubing and the roller and lies in covering relation to the roller's open end. The cover plate includes a stub shaft rotatably affixed to (by ball bearings) and extending axially outwardly from the center of the cover plate. The stub shaft engages the drive bracket mounted just inside the end of the roller, thereby maintaining the sealing relation between the cover plate and roller while not impeding, other than from the minimal friction between the cover plate and roller, the rotation of the roller. The cover plate assembly and motor assembly are both removably attached to the chassis' ends, and therefore their positions are interchangeable, thereby permitting the screed to be used effectively in abutting relation to obstacles, such as curbs or a form stake exposed above grade, while screeding in either direction with respect to the obstacle. Such versatility may be useful when screeding a sidewalk on both sides of a road and where the road has curbs on each side and a downhill grade. In such a scenario the direction of travel will preferably be uphill to more easily guide the screed over the concrete, and in order to screed up to the curb it would be necessary to move the motor from one end of the roller to the other.

A pair of telescoping handles, extending in spaced, parallel relation to one another, are attached to and extend diagonally and upwardly from the chassis. Each handle is individually telescopic so as to be adjusted to a predetermined length suitable for the operator. Also, each handle is independently, slidably adjustable along the length of the chassis, thereby permitting the spacing between the handles to be adjusted to accommodate the operator (or operators).

Also, attached to the chassis are a pair of wheels, each of which is attached to the end of a short length of tubing which is, in turn, slidably mounted, both axially and transverse, to the chassis. Preferably each wheel will be mounted adjacently outboard to one of the handles. The wheels provide for a kickstand or prop for permitting the roller to be lifted off the ground for cleanup purposes, or for ease of movement of the screed to and from the worksite, thereby permitting the screed to be moved when not in use without having to engage the roller with the ground which might cause nicks and scrapes to be formed in the roller.

Finally, a throttle is removably attached to one handle and electrically connected via a wire to the motor. The removable relationship between the throttle and handle permits the throttle to be secured to the handle positioned to the same side of the roller as is the motor.

An alternate embodiment of the screed apparatus includes a second motor operably attached to the end of the roller opposite to which the first motor is attached, and a second throttle attached to a handle and electrically connected to the second motor. The use of a second motor doubles the amount of torque that may be transferred to the roller, thereby permitting longer rollers to be used and, hence, wider areas to be screeded.

BRIEF DESCRIPTION OF THE DRAWINGS

The foregoing and other features of the invention will be more readily understood and fully appreciated from the following Detailed Description, taken in conjunction with the accompanying drawings, in which.

DETAILED DESCRIPTION

Figures 1, 3:
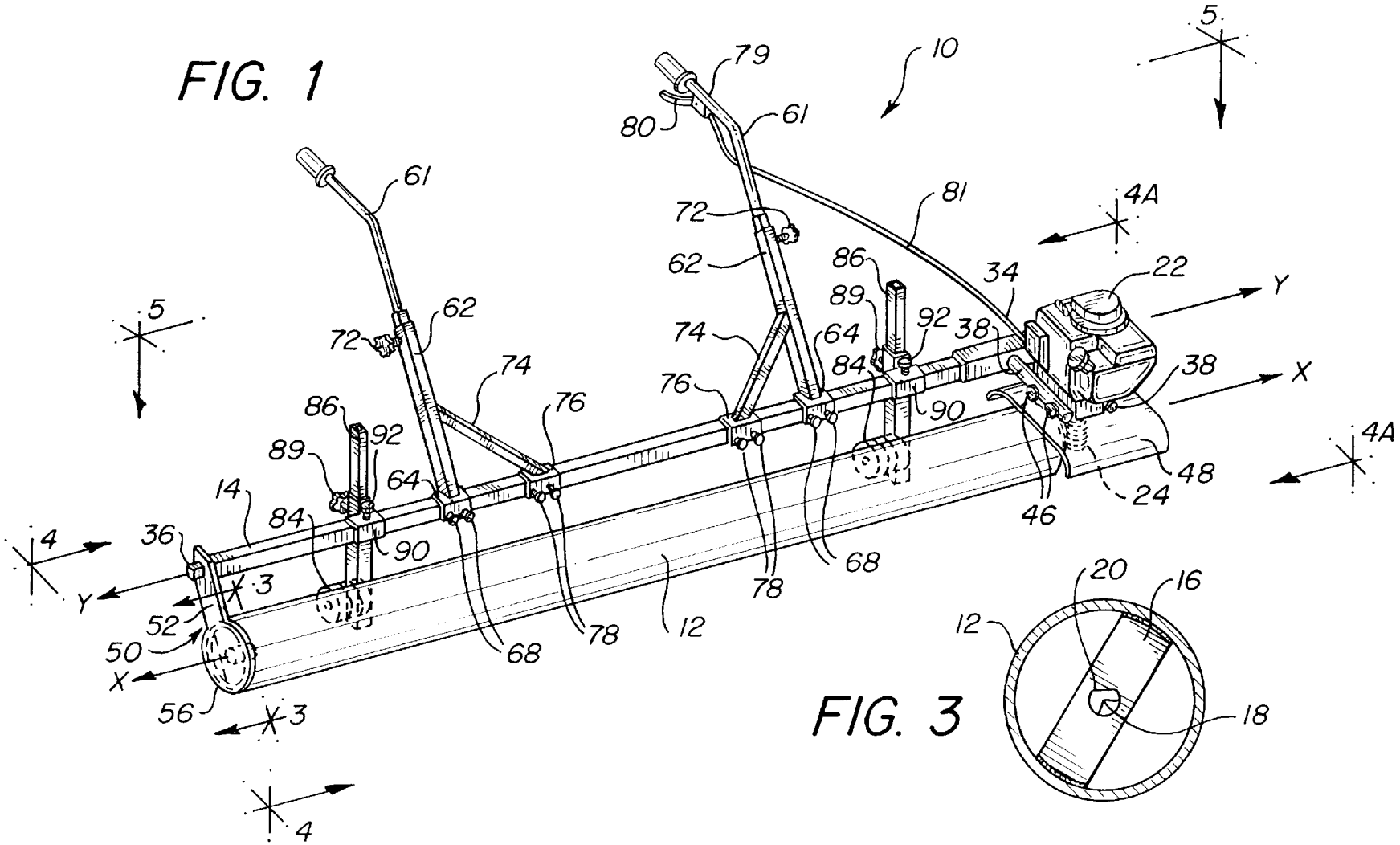
FIG. 1 is a perspective view of the present invention.
FIG. 3 is a cross-sectional view taken along section line 3—3 of FIG. 1.
Figure 2:
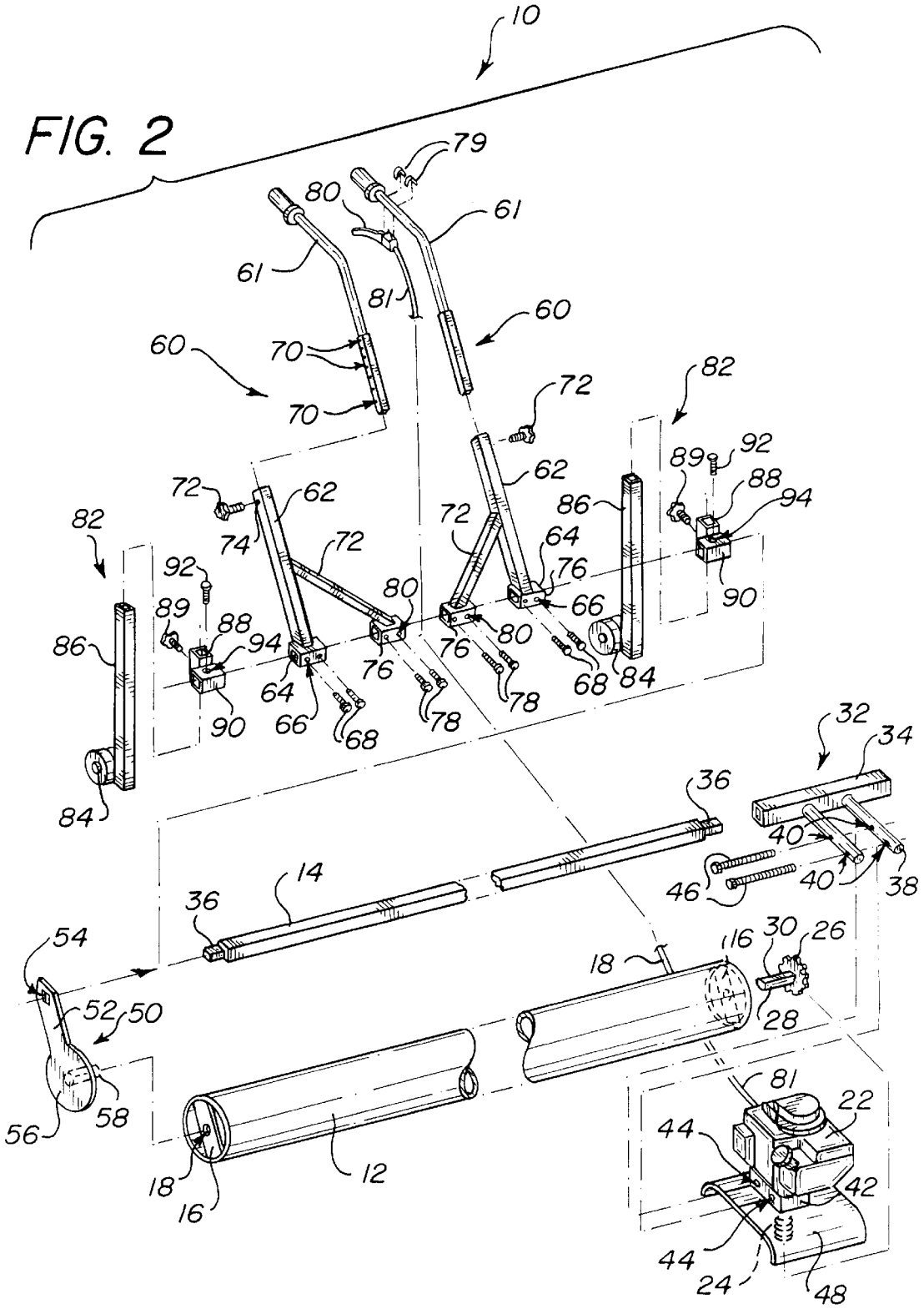
FIG. 2 is an exploded perspective thereof.
Figure 4:
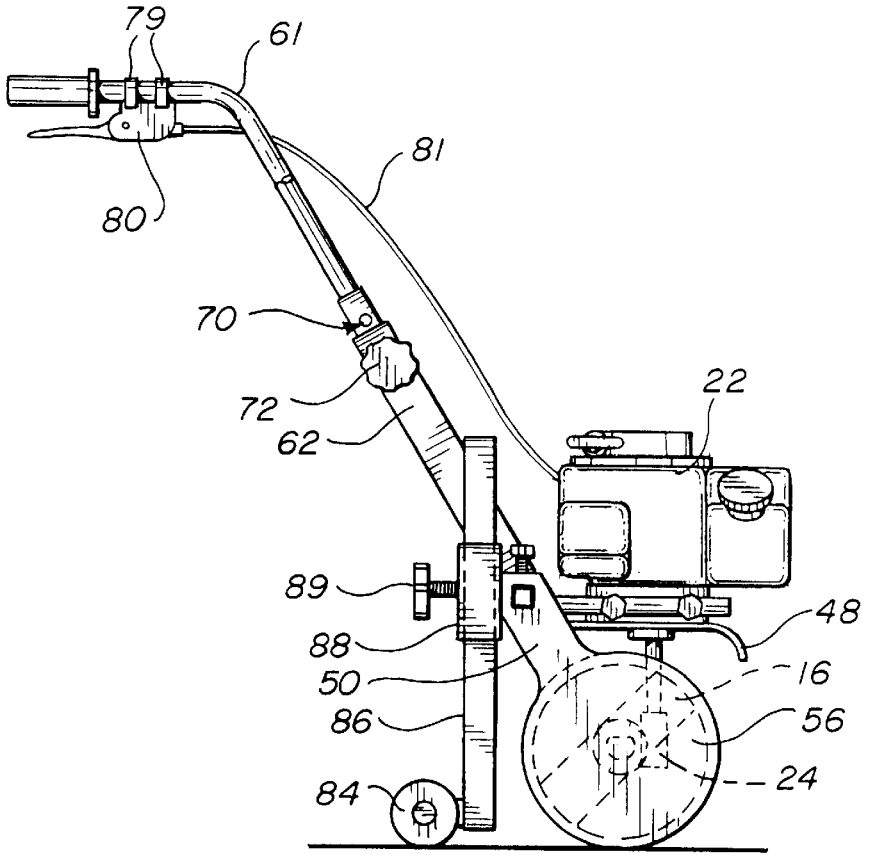
FIG. 4 is a left side elevational view taken along sight line 4—4 of FIG. 1.
Figure 4A:
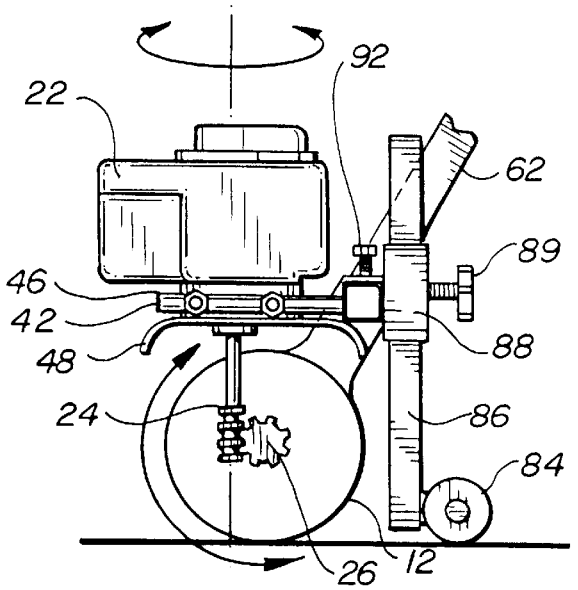
FIG. 4*a* is a right side elevational view taken along sight line 4*a*—4*a* of FIG. 1.
Figure 5:
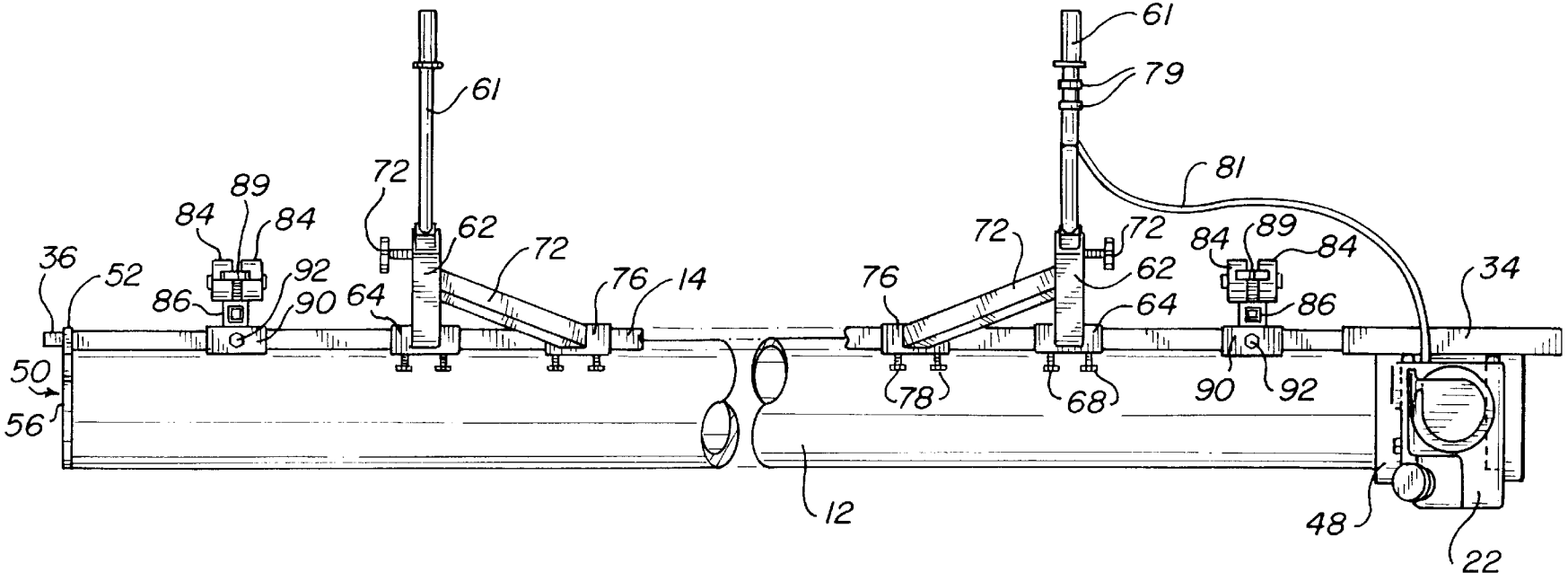
FIG. 5 is a top plan view of the present invention taken along sight line 5—5 of FIG. 1.

Referring now to the drawings wherein like reference numerals refer to like parts throughout, there is seen in FIG. 1 a concrete screed apparatus denoted generally by reference numeral 10. Screed apparatus 10 includes an elongated roller 12 mounted for rotation about its longitudinal axis X—X to a longitudinal chassis 14 which is comprised of an elongated strip of square cross-section tubing which extends along its longitudinal axis Y—Y in spaced, parallel relation to roller 12. Roller 12 and chassis 14 are of about the same predetermined length.

Roller 12 is comprised of a hollow, open ended tube and composed of aluminum, stainless steel or any other suitable material. With particular reference to FIG. 3, a pair of drive brackets 16 are fixedly mounted diametrically across the interior of roller 12, with one bracket being positioned immediately adjacent each end of roller 12. Each bracket 16 includes an opening 18 formed centrally therethrough, essentially co-axially with longitudinal axis X—X. Opening 18 is predominantly circular in shape and of predetermined diameter, but it does include one flat edge 20 for reasons which will be explained hereinafter.

Roller 12 is rotatably driven about its axis X—X by means of a conventional motor 22 which translates rotary motion to roller 12 through a worm gear 24 and regular gear 26 which meshingly engage one another. Roller 12 rotates about axis X—X, preferably in the direction opposite to which it is being passed over the concrete. This ensures the smoothest, most level resulting pavement.

Motor 22 directly drives worm gear 24 which, in turn, engages and rotates gear 26. Gear 26 is attached to one end of a drive shaft 28 whose opposite end engages opening 18 formed through drive bracket 16. Drive shaft 28, therefore, is of predominantly circular cross-section of about the same diameter as opening 18, but includes one flat surface 30 which corresponds with flat edge 20 of opening 18. Thus, when motor 22 is actuated, worm gear 24 rotates about its longitudinal axis, meshingly engaging and accordingly rotating gear 26 which, in turn, rotates drive shaft 28 which then engages drive bracket 16, effecting transfer of its rotational motion to roller 12. Due to the engagement of flat edge 30 (drive shaft 28) with flat edge 20 (opening 18), there will be no slippage of shaft 28 with respect to bracket 16, and hence roller 16 will rotate at a uniform rate.

Motor 22 may be releasably attached outboard of either end of chassis 14 by means of a motor mounting bracket, denoted generally by reference numeral 32. Motor bracket 32 includes a tubular sleeve 34 which is sized to matingly, securely engage either knobbed end 36 of chassis 14, and a pair of arms 38 which extend outwardly from one surface of sleeve 34 in longitudinally spaced, parallel relation to one another. Each arm 38 includes a pair of laterally spaced apart holes 40 which extend parallel to one another formed therethrough, with the holes 40 formed through one arm 38 being axially aligned with the corresponding holes 40 formed through the other arm 38. Motor 22 is mounted on a block 42 having a width slightly less than the distance separating arms 38, and having a pair of holes 44 formed therethrough, the holes being laterally spaced apart a distance corresponding to that of holes 40. After motor mounting bracket 32 is secured onto one end 36 of chassis 14, block 42 (having motor 22 mounted thereon) may be slid between arms 38 until corresponding holes 40 and holes 44 are axially aligned. Once they are aligned, one screw 46 may be passed through each set of axially aligned holes 40 and 44, thereby securely and effectively removably attaching motor 22 to chassis 14. A shield 48 may be mounted to the bottom side of block 42 to prevent foreign bodies from coming into contact with worm gear 24 and gear 26, as well as any of the other internal parts of motor 22.

While motor 22 is mounted to one end 36 of chassis 14 with gearing and shield 48 providing some cover to the open end of roller 12, a sealing member, denoted generally 50, is attached to the opposite end 36 of chassis 14 and provides a covering for that open end of roller 12. Sealing member 50 includes an arm 52 which includes a hole 54 formed therethrough which may be placed into secure engagement with end 36, thereby releasably attaching member 50 to chassis 14. Alternatively, member 50 could include a mounting identical to motor mounting bracket 32. Member 50 also includes a circular cover plate 56, integrally extending from arm 52, which is positioned in covering relation to the open end of roller 12 when member 50 is attached to chassis 14, thereby preventing wet concrete, or other foreign matter from infiltrating roller 12 and possibly damaging the drive bracket 16 mounted therein. To further prohibit foreign matter from damaging the drive bracket 16 mounted adjacent member 50, cover plate 56 includes a drive shaft 58, identical to drive shaft 28, rotatably attached thereto by ball bearings (not shown) and extending axially outwardly therefrom. When member 50 is attached to chassis 14 with cover plate 56 positioned in covering relation to the roller's open end, drive shaft 58 engages hole 12 of drive bracket 16 and rotates with roller 12 at the rate dictated by motor 22. By having drive shaft 58 engaged with drive bracket 18, any foreign material that may get inside roller 12 despite cover plate 56 will not damage drive bracket 18.

To pass screed assembly 10 over freshly poured concrete, a pair of handle assemblies, denoted generally 60, are attached to, and selectively movable with respect to chassis 14. Handle assemblies 60 include handles 61 for manual grasping by an operator to push/pull screed apparatus 10 over the concrete. Each handle 61 is telescopically positioned within a tube 62 which is independently, slidably attached to chassis by a sleeve 64 to which it is fixedly attached at one end thereof. Sleeves 64 are slidably mounted on chassis 14 for sliding movement along axis Y—Y, and each includes a pair of holes 66 formed therethrough which cooperatively receive screws 68 therein to securely retain handle assemblies 60 on chassis 14. The sliding adjustments that may be made to handle assemblies 60 with respect to chassis 14 permit the distance separating handles 61 to be selectively determined to comfortably accommodate any operator. Handles 61 may be telescopingly adjusted within tubes 62 to any desired length. One of a plurality of holes 70 formed through handles 61 along their respective longitudinal axes receives a screw 72 which passes through a hole 74 formed through the top end of tube 62, thereby securely retaining handle 61 within tube 62 at a desired position. Accordingly, both the distance separating handle assemblies 60 and the effective length of handles 60 are selectively controllable by an operator of apparatus 10.

To provide more rigidity and stability to handle assemblies 60, each assembly includes a stabilizing member 74 fixedly attached at one end to, and extending diagonally, downwardly, and inwardly from an intermediate position along tubes 62. Stabilizing members 74 are slidably attached to chassis 14 by sleeves 76 which are attached to their members' 74 lower ends, and which are essentially identical to sleeves 64. A pair of screws 78 pass through holes 80 formed through sleeves 76 to securely retain them in position with respect to chassis 14.

Releasably attached by clips 79, or any other suitable means, to the handle 61 positioned to the same side of chassis 14 as motor 22 is a throttle 80 which is electrically connected to motor 22 by a wire 81. Throttle 80 permits the operator to selectively control the speed at which motor 22 causes roller 12 to rotate. An ignition switch (not shown) to start motor 22 could also be releaseably attached to handle 61 and electrically connected to motor 22 if desired.

Another component of the principal embodiment of apparatus 10 is a pair of wheel assemblies, denoted generally 82, which permit apparatus 10 to be propped up, thereby elevating roller 12 off the ground and permitting roller 12 to be easily cleaned by having it rotate while simultaneously rinsing it with a hose. Also, wheel assemblies 82 permit apparatus 10 to be easily transported to and from a work site without having to engage roller 12 with the ground which could thereby damage roller 12 (although apparatus 10 is very lightweight and could be carried if desired). Wheel assemblies 82 each include at least one wheel (or caster) 84 rotatably mounted to the bottom end of a tube 86. Tube 86 telescopically engages a vertically oriented sleeve 88 where it is held in place by a screw 89 which passes through a hole (not seen) in sleeve 88 and engages one of a series of holes (not seen) formed through tube 86 and positioned along its longitudinal axis. Sleeve 88 is fixedly attached to one side surface of another sleeve 90 which is mounted for sliding movement on chassis 14. Sleeve 90 may be slid along axis Y—Y of chassis 14, and may be fixed in position by a screw 92 which passes through a hole 94 formed through the top surface of sleeve 90. Accordingly, when apparatus 10 is being used to screed concrete, tube 86 may be telescopically raised through sleeve 88 in order to take wheels 84 out of engagement with the ground, and when it is necessary to clean roller 12 or move apparatus 10 to and from a worksite, tube 86 may be telescopically lowered through sleeve 88 until wheels 84 operatively engage the ground with enough clearance to prevent roller 12 from contacting the ground. While it is preferable for wheel assemblies 82 to be mounted outboard of their adjacent handle assembly 60 to give maximum stability when moving apparatus 10, sleeves 90 permit them to be slid along the longitudinal axis Y—Y to any desired position along chassis 14.

Figure 6:
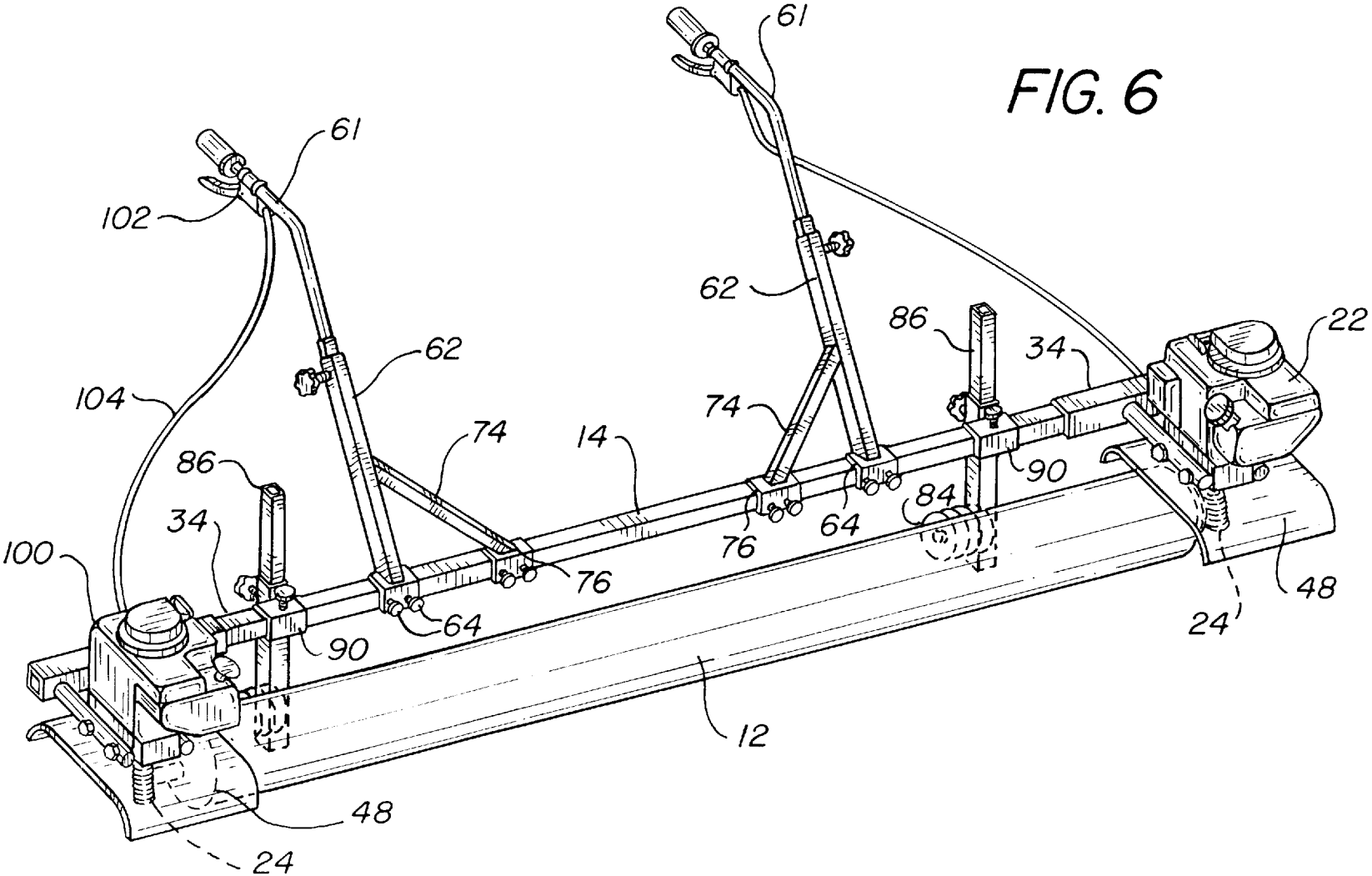
FIG. 6 is a perspective view of an alternate embodiment of the present invention.

Referring now to FIG. 6, there is seen an alternate embodiment of screed apparatus 10. In this alternate embodiment, the only difference from the preferred embodiment is the addition of a second motor 100 operably attached to the opposite end of roller 12 as motor 22 instead of having sealing member 50 attached in that position. An additional throttle 102 releasably attached to handle 61 and wire lead 104 electrically interconnecting throttle 102 to motor 10 is also added to control the amount of torque motor 100 transfers to roller 12. The rest of apparatus 10 remains the same as in the preferred embodiment, including the manner and apparatus used to mount motor 100 to chassis 14.

The additional motor 100 will double the potential amount of torque that may be delivered to roller 12, thereby permitting twice as much torque (assuming motors of equal horsepower) to be delivered to roller 12. Such additional power may be desired for large scale projects or where a longer or heavier roller 12 is employed. Where a longer or heavier than usual roller 12 is employed, the independent adjustability of handle assemblies 82 permit two users to operate apparatus 10, as opposed to a single operator.

What is claimed is:

1. An apparatus for screeding concrete, comprising:

a) an elongated chassis having first and second opposed, terminal ends, and extending along a first longitudinal axis;

b) an elongated roller of predetermined diameter rotatably connected to said chassis, said roller including first and second open, opposed, terminal ends, said roller extending in spaced parallel relation to said chassis along a second longitudinal axis;

c) motor means mounted to one of said first and second terminal ends of said chassis;

d) gear means operably interconnecting said motor means to said roller, whereby actuation of said motor means causes said gear means to effect rotation of said roller about its said second longitudinal axis;

e) first and second elongated arms attached to and extending perpendicularly outwardly from said chassis, and in spaced, parallel relation to one another, said first and second arms each including at least one hole formed transversely therethrough, with said at least one hole formed through said first arm being positioned in axially aligned relation with a corresponding one of said at least one hole formed through said second arm;

f) a mounting block securely attached to said motor means, said mounting block having at least one hole formed therethrough which is positioned in axially aligned relation to a corresponding one of said at least one holes formed through said first and second arms; and g) means for fastening said mounting block to said first and second arms.

2. The apparatus according to claim 1 wherein said roller is hollow, and said roller includes interior and exterior surfaces.

3. The apparatus according to claim 2 and further comprising first and second brackets each having first and second ends and a hole of predetermined shape formed centrally therethrough, said first and second brackets extending diametrically across the interior of said roller and being fixedly attached at their first and second ends to said interior surface of said roller, said first and second brackets being positioned adjacent said first and second terminal ends of said roller, respectively, with said hole formed centrally through each of said first and second brackets being co-axial with said second longitudinal axis.

4. The apparatus according to claim 3 wherein said gear means includes:

a) a first gear mounted for direct engagement to said motor means;

b) a first elongated drive shaft having first and second opposite ends and a predetermined cross-sectional shape, said drive shaft extending longitudinally along said second longitudinal axis, and said first end being positioned in non-slipping relation to said hole formed through either of said first and second brackets; and c) a second gear fixedly attached to said second end of said drive shaft and positioned in meshing engagement with said first gear, whereby upon actuation of said motor means, said first gear rotates and meshingly engages with said second gear thereby causing said second gear, and hence said drive shaft, to rotate, which, in turn, effects rotation of said roller.

5. The apparatus according to claim 4 wherein the shape of said hole formed through each of said first and second brackets, and the shape of said drive shaft are all predominantly circular with at least one straight edge.

6. The apparatus according to claim 3 and further comprising a sealing assembly releasably attached to the opposite of said chassis' first and second terminal ends to which said motor means is attached.

7. The apparatus according to claim 6 wherein said sealing assembly includes:

a) an arm having first and second ends and being releasably attached at its said first end to either of said first and second terminal ends of said chassis; and b) a circular cover plate having a diameter about the same as said predetermined diameter of said roller, said cover plate integrally attached to said second end of said arm and being positioned in covering relation to one of said first and second ends of said roller, whereby said cover plate prevents foreign matter from entering into the end of said roller to which it is covering.

8. The apparatus according to claim 1 wherein said motor means includes a first, gasoline powered motor.

9. The apparatus according to claim 1 wherein said chassis and said roller are of about equal length.

10. The apparatus according to claim 1 wherein said fastening means includes a screw for passing through said at least one hole formed through said first and second arms and said mounting block, and a nut threadingly attached to said screw, whereby said nut prevents said screw from becoming disengaged from said at least one hole.

11. The apparatus according to claim 1 and further comprising first and second handles extending upwardly from and mounted to said chassis.

12. The apparatus according to claim 11 wherein said first and second handles are each mounted to said chassis for independent sliding movement along said first longitudinal axis, whereby the distance separating said first handle from said second handle may be selectively adjusted.

13. The apparatus according to claim 11 wherein said handles are independently, telescopically adjustable, whereby the lengths of said first and second handles may be selectively adjusted.

14. The apparatus according to claim 11 and further comprising means for selectively controlling the power output of said motor means.

15. The apparatus according to claim 14 wherein said power control means includes a throttle releasably attached to one of said first and second handles, said throttle being electrically connected to said motor means.

16. The apparatus according to claim 1 and further comprising first and second wheel assemblies attached to and extending downwardly from said chassis.

17. The apparatus according to claim 16 wherein said first and second wheel assemblies are mounted to said chassis for sliding movement along said first longitudinal axis.

18. The apparatus according to claim 16 wherein said first and second wheel assemblies are telescopically adjustable with respect to said chassis, whereby the length of said first and second wheel assemblies may be selectively controlled and said first and second wheel assemblies may be positioned in either of engaged and disengaged relation with the ground.

19. The apparatus according to claim 1 wherein said motor means includes first and second motors operatively connected to said first and second ends of said roller, respectively.

20. An apparatus for screeding concrete, comprising:

a) an elongated chassis having first and second opposed, terminal ends, and extending along a first longitudinal axis;

b) an elongated roller of predetermined diameter rotatably connected to said chassis, said roller including first and second open, opposed, terminal ends, said roller extending in spaced parallel relation to said chassis along a second longitudinal axis;

c) motor means mounted to one of said first and second terminal ends of said chassis;

d) gear means operably interconnecting said motor means to said roller, whereby actuation of said motor means causes said gear means to effect rotation of said roller about its said second longitudinal axis;

e) means for mounting said motor means to one of said first and second terminal ends of said chassis; and f) first and second handles extending upwardly from and mounted to said chassis for independent sliding movement along said first longitudinal axis, whereby the distance separating said first handle from said second handle may be selectively adjusted.

21. The apparatus according to claim 20 wherein said roller is hollow, and said roller includes interior and exterior surfaces.

22. The apparatus according to claim 21 and further comprising first and second brackets each having first and second ends and a hole of predetermined shape formed centrally therethrough, said first and second brackets extending diametrically across the interior of said roller and being fixedly attached at their first and second ends to said interior surface of said roller, said first and second brackets being positioned adjacent said first and second terminal ends of said roller, respectively, with said hole formed centrally through each of said first and second brackets being co-axial with said second longitudinal axis.

23. The apparatus according to claim 22 wherein said gear means includes:

a) a first gear mounted for direct engagement to said motor means;

b) a first elongated drive shaft having first and second opposite ends and a predetermined cross-sectional shape, said drive shaft extending longitudinally along said second longitudinal axis, and said first end being positioned in non-slipping relation to said hole formed through either of said first and second brackets; and c) a second gear fixedly attached to said second end of said drive shaft and positioned in meshing engagement with said first gear, whereby upon actuation of said motor means, said first gear rotates and meshingly engages with said second gear thereby causing said second gear, and hence said drive shaft, to rotate, which, in turn, effects rotation of said roller.

24. The apparatus according to claim 23 wherein the shape of said hole formed through each of said first and second brackets, and the shape of said drive shaft are all predominantly circular with at least one straight edge.

25. The apparatus according to claim 22 and further comprising a sealing assembly releasably attached to the opposite of said chassis' first and second terminal ends to which said motor means is attached.

26. The apparatus according to claim 25 wherein said sealing assembly includes:

a) an arm having first and second ends and being releasably attached at its said first end to said first and second terminal ends of said chassis; and b) a circular cover plate having a diameter about the same as said predetermined diameter of said roller, said cover plate integrally attached to said second end of said arm and being positioned in covering relation to one of said first and second ends of said roller, whereby said cover plate prevents foreign matter from entering into the end of said roller to which it is covering.

27. The apparatus according to claim 20 wherein said motor means includes a first, gasoline powered motor.

28. The apparatus according to claim 20 wherein said chassis and said roller are of about equal length.

29. The apparatus according to claim 20 wherein said means for mounting said motor means to one of said first and second terminal ends of said chassis includes:

a) first and second elongated arms attached to and extending perpendicularly outwardly from said chassis, and in spaced, parallel relation to one another, said first and second arms each including at least one hole formed transversely therethrough, with said at least one hole formed through said first arm being positioned in axially aligned relation with a corresponding one of said at least one hole formed through said second arm;

b) a mounting block securely attached to said motor means, said mounting block having at least one hole formed therethrough which is positioned in axially aligned relation to a corresponding one of said at least one holes formed through said first and second arms; and c) means for fastening said mounting block to said first and second arms.

30. The apparatus according to claim 20 wherein said fastening means includes a screw for passing through said at least one hole formed through said first and second arms and said mounting block, and a nut threadingly attached to said screw, whereby said nut prevents said screw from becoming disengaged from said at least one hole.

31. The apparatus according to claim 20 wherein said handles are independently, telescopically adjustable, whereby the lengths of said first and second handles may be selectively adjusted.

32. The apparatus according to claim 20 and further comprising means for selectively controlling the power output of said motor means.

33. The apparatus according to claim 32 wherein said power control means includes a throttle releasably attached to one of said first and second handles, said throttle being electrically connected to said motor means.

34. The apparatus according to claim 20 and further comprising first and second wheel assemblies attached to and extending downwardly from said chassis.

35. The apparatus according to claim 34 wherein said first and second wheel assemblies are mounted to said chassis for sliding movement along said first longitudinal axis.

36. The apparatus according to claim 34 wherein said first and second wheel assemblies are telescopically adjustable with respect to said chassis, whereby the length of said first and second wheel assemblies may be selectively controlled and said first and second wheel assemblies may be positioned in either of engaged and disengaged relation with the ground.

37. The apparatus according to claim 20 wherein said motor means includes first and second motors operatively connected to said first and second ends of said rollers, respectively.

38. An apparatus for screeding concrete, comprising:

a) an elongated chassis having first and second opposed, terminal ends, and extending along a first longitudinal axis;

b) an elongated roller of predetermined diameter rotatably connected to said chassis, said roller including first and second open, opposed, terminal ends, said roller extending in spaced parallel relation to said chassis along a second longitudinal axis;

c) motor means mounted to one of said first and second terminal ends of said chassis;

d) gear means operably interconnecting said motor means to said roller, whereby actuation of said motor means causes said gear means to effect rotation of said roller about its said second longitudinal axis;

e) means for mounting said motor means to one of said first and second terminal ends of said chassis; and f) wheel assembly means attached to and extending downwardly from said chassis, said wheel assembly means being mounted to said chassis for sliding movement along said first longitudinal axis.

39. The apparatus according to claim 38 wherein said roller is hollow, and said roller includes interior and exterior surfaces.

40. The apparatus according to claim 39 and further comprising first and second brackets each having first and second ends and a hole of predetermined shape formed centrally therethrough, said first and second brackets extending diametrically across the interior of said roller and being fixedly attached at their first and second ends to said interior surface of said roller, said first and second brackets being positioned adjacent said first and second terminal ends of said roller, respectively, with said hole formed centrally through each of said first and second brackets being co-axial with said second longitudinal axis.

41. The apparatus according to claim 40 wherein said gear means includes:

a) a first gear mounted for direct engagement to said motor means;

b) a first elongated drive shaft having first and second opposite ends and a predetermined cross-sectional shape, said drive shaft extending longitudinally along said second longitudinal axis, and said first end being positioned in non-slipping relation to said hole formed through either of said first and second brackets; and c) a second gear fixedly attached to said second end of said drive shaft and positioned in meshing engagement with said first gear, whereby upon actuation of said motor means, said first gear rotates and meshingly engages with said second gear thereby causing said second gear, and hence said drive shaft, to rotate, which, in turn, effects rotation of said roller.

42. The apparatus according to claim 41 wherein the shape of said hole formed through each of said first and second brackets, and the shape of said drive shaft are all predominantly circular with at least one straight edge.

43. The apparatus according to claim 40 and further comprising a sealing assembly releasably attached to the opposite of said chassis' first and second terminal ends to which said motor means is attached.

44. The apparatus according to claim 43 wherein said sealing assembly includes:

a) an arm having first and second ends and being releasably attached at its said first end to either of said first and second terminal ends of said chassis; and b) a circular cover plate having a diameter about the same as said predetermined diameter of said roller, said cover plate integrally attached to said second end of said arm and being positioned in covering relation to one of said first and second ends of said roller, whereby said cover plate prevents foreign matter from entering into the end of said roller to which it is covering.

45. The apparatus according to claim 38 wherein said motor means includes a first, gasoline powered motor.

46. The apparatus according to claim 38 wherein said chassis and said roller are of about equal length.

47. The apparatus according to claim 38 wherein said means for mounting said motor means to one of said first and second terminal ends of said chassis includes:

a) first and second elongated arms attached to and extending perpendicularly outwardly from said chassis, and in spaced, parallel relation to one another, said first and second arms each including at least one hole formed transversely therethrough, with said at least one hole formed through said first arm being positioned in axially aligned relation with a corresponding one of said at least one hole formed through said second arm;

b) a mounting block securely attached to said motor means, said mounting block having at least one hole formed therethrough which is positioned in axially aligned relation to a corresponding one of said at least one holes formed through said first and second arms; and c) means for fastening said mounting block to said first and second arms.

48. The apparatus according to claim 47 wherein said fastening means includes a screw for passing through said at least one hole formed through said first and second arms and said mounting block, and a nut threadingly attached to said screw, whereby said nut prevents said screw from becoming disengaged from said at least one hole.

49. The apparatus according to claim 38 and further comprising first and second handles extending upwardly from and mounted to said chassis.

50. The apparatus according to claim 49 wherein said first and second handles are each mounted to said chassis for independent sliding movement along said first longitudinal axis, whereby the distance separating said first handle from said second handle may be selectively adjusted.

51. The apparatus according to claim 49 wherein said handles are independently, telescopically adjustable, whereby the lengths of said first and second handles may be selectively adjusted.

52. The apparatus according to claim 49 and further comprising means for selectively controlling the power output of said motor means.

53. The apparatus according to claim 52 wherein said power control means includes a throttle releasably attached to one of said first and second handles, said throttle being electrically connected to said motor means.

54. The apparatus according to claim 38 wherein said wheel assembly means include first and second wheel assemblies which are telescopically adjustable with respect to said chassis, whereby the length of said first and second wheel assemblies may be selectively controlled and said first and second wheel assemblies may be positioned in either of engaged and disengaged relation with the ground.

55. The apparatus according to claim 38 wherein said motor means includes first and second motors operatively connected to said first and second ends of said roller, respectively.

* * * * *

UNITED STATES PATENT AND TRADEMARK OFFICE

CERTIFICATE OF CORRECTION

PATENT NO. : 5,803,656

DATED : September 8, 1998

INVENTOR(S) : Turck

It is certified that error appears in the above-indentified patent and that said Letters Patent is hereby corrected as shown below:

Title page, item [54] and col. 1,

In the title, please delete "roler" and replace with --roller--

In the claims, column 10, line 38, please delete "sliding"

Signed and Sealed this

Sixth Day of April, 1999

*Attest:*

*Attesting Officer*

Q. TODD DICKINSON

*Acting Commissioner of Patents and Trademarks*